US006076761A

United States Patent [19]

Bartelmuss et al.

[11] Patent Number: 6,076,761

[45] Date of Patent: Jun. 20, 2000

[54] APPARATUS FOR SEVERING A PAPER WEB

[76] Inventors: Klaus Bartelmuss; Heinz Bartelmuss, both of NR. 63, A-8833 Teufenbach, Austria

[21] Appl. No.: 09/104,304

[22] Filed: Jun. 24, 1998

[30] Foreign Application Priority Data

Jun. 24, 1997 [AT] Austria ..... 1081/97

[51] Int. Cl.[7] ..... B65H 35/08

[52] U.S. Cl. ..... 242/526.2

[58] Field of Search ..... 242/526.2

[56] References Cited

U.S. PATENT DOCUMENTS

| | | | |
|---|---|---|---|
| 3,765,615 | 10/1973 | Brink et al. | 242/526.2 |
| 4,757,950 | 7/1988 | Rodriguez . | |
| 4,964,584 | 10/1990 | Taipale et al. | 242/526.2 |
| 5,046,675 | 9/1991 | Rodriguez | 242/526.2 |
| 5,725,177 | 3/1998 | Bartelmuss . | |

FOREIGN PATENT DOCUMENTS

0708049A1 4/1996 European Pat. Off. .

*Primary Examiner*—Donald P. Walsh
*Assistant Examiner*—William A. Rivera
*Attorney, Agent, or Firm*—Herbert L. Lerner; Laurence A. Greenberg; Werner H. Stemer

[57] ABSTRACT

A paper web that is being wound onto a rotating drum is severed so that it can be wound onto a second, empty drum. The paper web is severed with a tear strip that extends transversely to the paper web. A free end of the tear strip can be fastened to the empty drum, whereby the tear strip is wound helically on the empty drum and thereby severs the paper web. The free end of the tear strip is moved towards the empty drum with an apparatus that includes a carriage which is displaceably mounted towards the empty drum, laterally outside the drum and transversely in relation to the drum axis. A suction device for holding the tear strip is disposed on the carriage. The suction device is controlled by a vacuum source with which it communicates through a suction line.

4 Claims, 8 Drawing Sheets

APPARATUS FOR SEVERING A PAPER WEB

BACKGROUND OF THE INVENTION

1. Field of the Invention

The present invention relates to an apparatus for severing a paper web, which is being wound onto a rotating drum, for the purpose of initiating the winding of the paper web onto an empty rotating drum. The paper web is severed with a tear strip, which extends transversely in relation to the paper web and whose free end can be fastened to the empty drum. When the free end of the tear strip is fastened to the empty drum, it is helically wound on the drum and it thereby severs the paper web. The apparatus has a carriage which can be displaced along the axis of the empty drum, laterally outside the latter and transversely in relation to this axis, and on which there is disposed a device for holding the tear strip.

2. Description of the Related Art

An apparatus of that type is described in U.S. Pat. No. 4,757,950 to Rodriquez. There, the tear strip (the cutting tape) is pushed through a guide rail extending transversely relative to the paper web, from one side of the paper web to the other side of the paper web, the free end of the tape being located in the region of the nip formed between the two drums. As soon as the severing operation is to be started, the tear strip is advanced by means of a conveying device, so that its free end comes to rest on the empty drum and it is glued to the latter by applying adhesive. As a result, the tear strip is torn out of the guide rail and, due to the rotation of the empty drum, is wound helically on the latter, thereby severing the paper web in the process. The paper web is then wound onto the empty drum.

The conveying device for the tear strip is located on a first side of the paper web and the severing operation is started on the other side of the paper web. It is thus necessary to push the tear strip through the guideway that extends transversely to the paper web, and to push it into the nip between the two drums. The tear strip has to have an adequate stiffness For this purpose, so that it can be pushed to the second side. For this reason, tear strips used for the prior art apparatus are produced from mutually adjacent, adhesively bonded paper cords.

Furthermore, our earlier U.S. Pat. No. 5,725,177 (corresp. to European EP 708 049 A1) discloses an apparatus in which the conveying device for the tear strip is located on that side of the paper web on which the severing operation starts. Since the tear strip is thus pulled through the guideway and only needs to be conveyed toward the empty drum, the tear strip tape may have a significantly lower stiffness. Accordingly, it is possible to use tear strips in that apparatus which are produced, for example, from folded paper sheets, the strips having a significantly lower thickness.

The disclosures of both above-noted disclosures are herewith incorporated by reference.

The tear strips must satisfy two basically contrary objectives. First, the tear strips must have a high tearing strength. Second, they should be as thin as possible, since they are wound onto the empty drum over which the paper web is subsequently wound up, whereby those layers of the paper web which are marked by impressions caused with the tear strip constitute waste. Since the tear strip should be fed to recycling together with the waste paper from the paper web, the tape should or must be produced from paper. In addition, the drums are formed with a rubber coating jacket, so that the tear strip must also be as soft as possible and have the lowest possible stiffness. If all these requirements are satisfied, however, this causes difficulties in conveying the tear strip toward the empty drum so that it comes to rest on the latter and initiates the severing operation.

The apparatus disclosed in the above-mentioned U.S. Pat. No. 4,757,950 is also constructed, on the other side of the paper web, to have a device which is intended to hold the tear strip firmly and which can be guided up to the surface of the empty drum by means of a carriage. As soon as the free end of the tear strip has been fastened to the empty drum, it must be released by the device by which it is being firmly held.

In that prior art apparatus the device that holds the tear strip is formed with two mutually pivoting clamping jaws. Upon starting the severing operation, the tear strip is torn out of these two clamping jaws. Since that tear strip is a stiff tape, it withstands the stress caused by the operation. However, as soon as a significantly thinner tear strip is used, there is a risk of its being destroyed as it is being torn out of the clamping jaws. In that event, it is no longer possible to carry out the severing operation of the paper web.

SUMMARY OF THE INVENTION

It is accordingly an object of the invention to provide an apparatus for severing a paper web, which overcomes the above-mentioned disadvantages of the prior art devices and methods of this general type and which provides for a device for holding the tear strip firmly and advancing it in such a way that destruction of the tear strip is reliably ruled out.

With the foregoing and other objects in view there is provided, in accordance with the invention, an apparatus for severing a paper web being wound onto a first rotating drum, and for initiating the winding of the paper web onto a second, empty drum, which comprises:

a tear strip extending transversely to a paper web being wound onto a first rotating drum, the tear strip having a free end to be fastened to an empty rotating drum, whereby the tear strip is helically wound onto the empty rotating drum and the tear strip severs the paper web;

a carriage disposed laterally adjacent the empty rotating drum, the carriage being displaceably mounted towards the empty drum and transversely to an axis of the empty drum; and a suction device for holding the tear strip disposed on the carriage and being movable with the carriage towards the empty drum, and a vacuum source communicating with the suction device through a suction line.

In accordance with an added feature of the invention, there is provided a compressed-air nozzle disposed in the vicinity of the suction device for moving the tear strip towards the suction device.

In accordance with an additional feature of the invention, the suction device is pivotally mounted on the carriage and the suction device is pivoted relative to the carriage during a movement of the carriage.

In accordance with a concomitant feature of the invention, there is provided an angle lever having a vertex, a first leg and a second leg, the angle lever being pivotally mounted about the vertex on the carriage, the suction device projecting transversely from the first leg of the angle lever, and a frame-fixed slotted guide along which the second leg of the angle lever is guided during the movement of the carriage.

Other features which are considered as characteristic for the invention are set forth in the appended claims.

Although the invention is illustrated and described herein as embodied in an apparatus for severing a paper web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing figures.

DESCRIPTION OF THE PREFERRED EMBODIMENTS

The following specification relates to an apparatus as it is described in our U.S. Pat. No. 5,725,177 (corresponding to EP 708 049 A1), which is incorporated by reference. The apparatus of our prior patent, in order to achieve the object of also being able to use a tear strip having a very low stiffness, is provided with an additional device according to this invention. The construction and the method of operation of the additional device will be described in the following.

Figure 1:
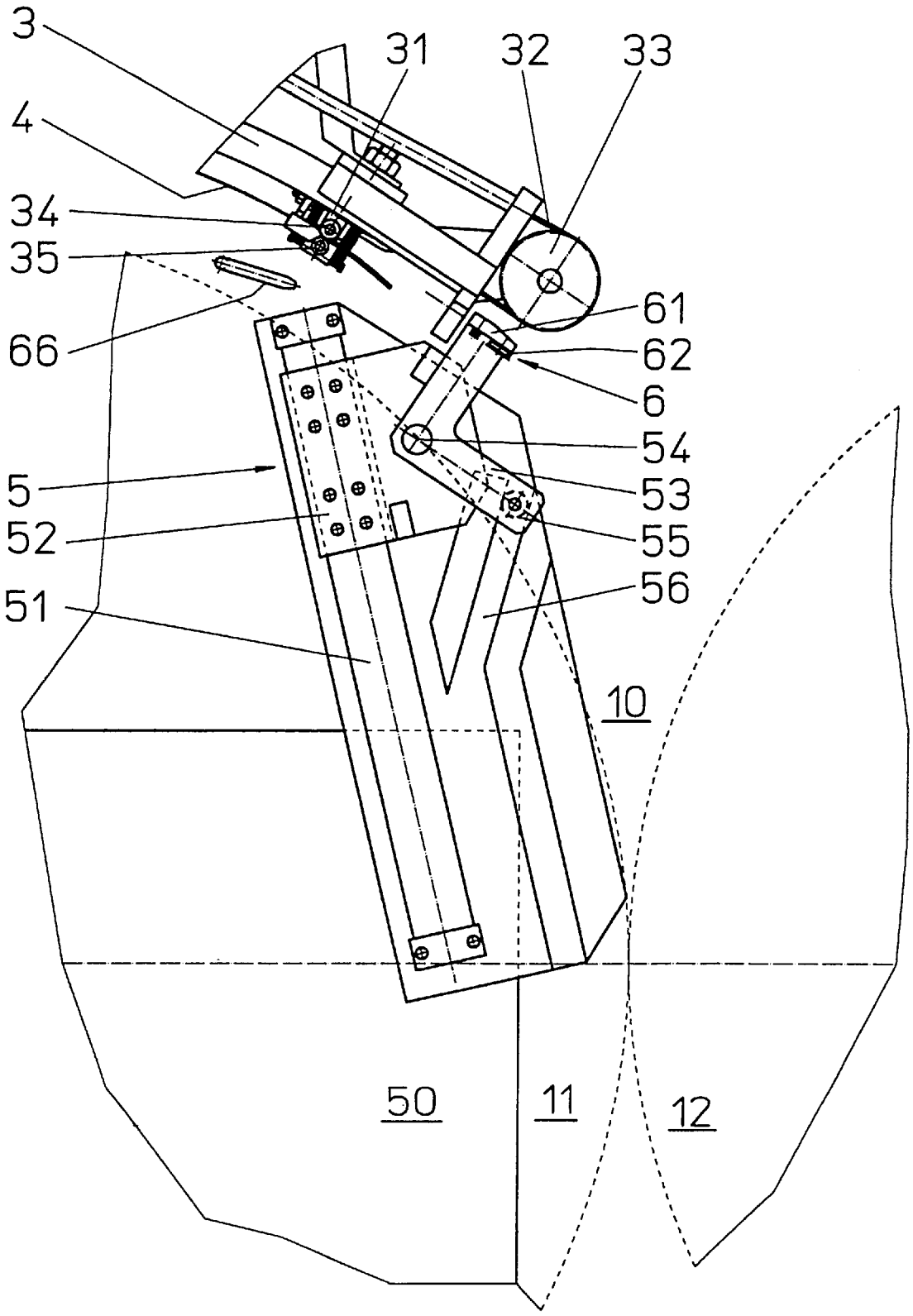
FIG. 1 is a partial side view of a device according to the invention.

Referring now to the figures of the drawing in detail and first, particularly, to FIG. 1 thereof, there is seen a channel 3, which extends transversely relative to the two drums onto which the paper web is wound up, which is arranged beneath the paper web, and which ends in the vicinity of the nip 10 formed by a drive drum 11 and the empty drum 12. A carriage 31 is guided in the channel 3, by means of which the free end of a tear strip 4 can be moved from one side of the paper web to the other side. The free end of the tear strip 4 is thereby conveyed into the region of the nip 10 between the two drums 11 and 12. In order to move the carriage 31, use is made of a pulling element 32, which is guided around a guide pulley 33 at the end of the channel 3. In addition, two clamp rollers 34 and 35, between which the tear strip 4 is guided, are mounted on the carriage 31.

FIG. 1 illustrates a position of the carriage 31 in which the carriage is located slightly before reaching its end position.

Figure 2:
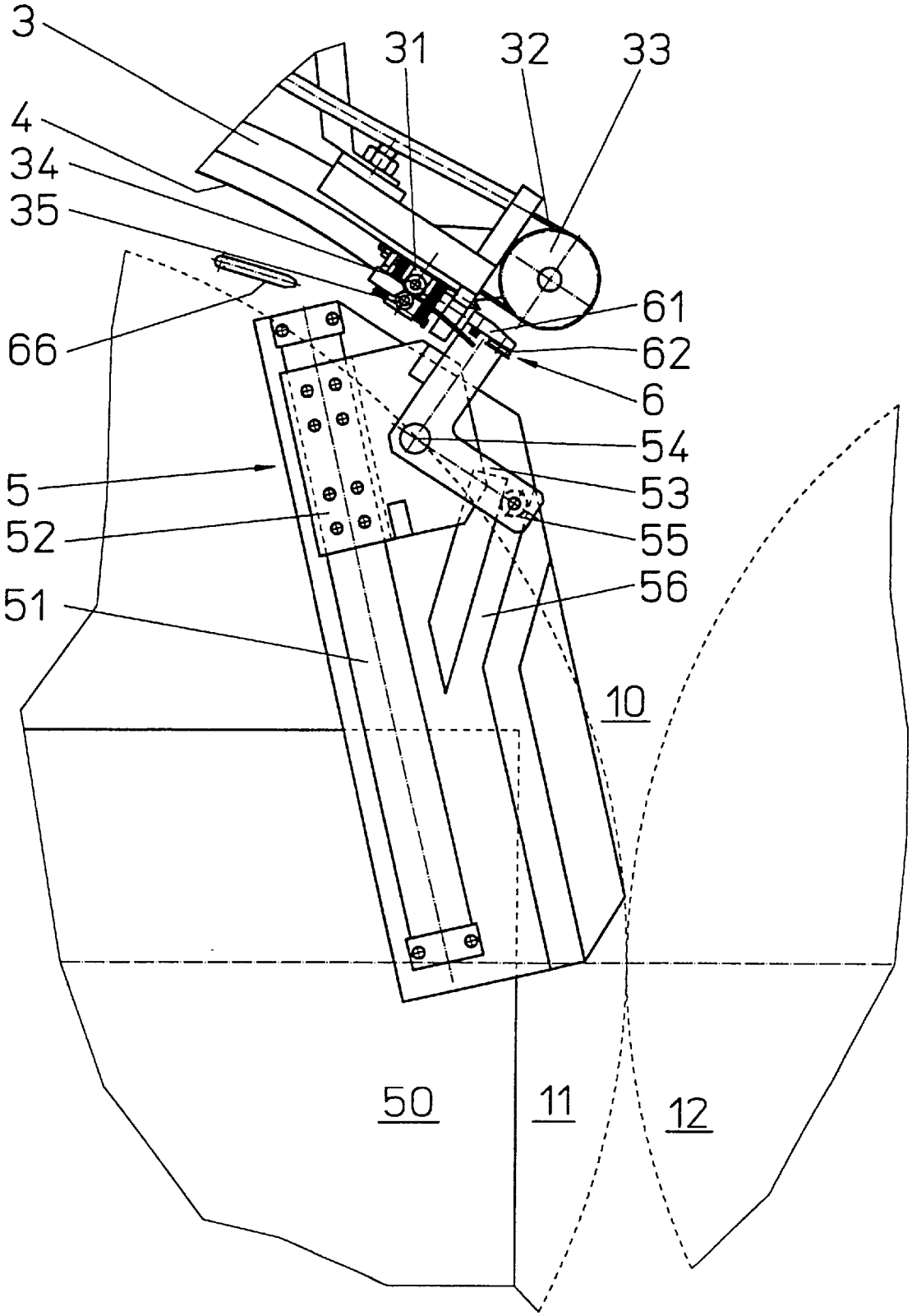
FIGS. 2 to 6 are similar views, showing the device in progressive stages as the tear strip is moved into the roller nip.

FIG. 2 shows the carriage 31 in its end position. As soon as the tear strip 4 is to be inserted into the nip 10 between the two drums 11 and 12 and is subsequently to be fastened to the empty drum 12, the two rollers 34 and 35 are driven. As a result, the tear strip 4 is advanced forward and downward into the nip 10.

Figure 3:
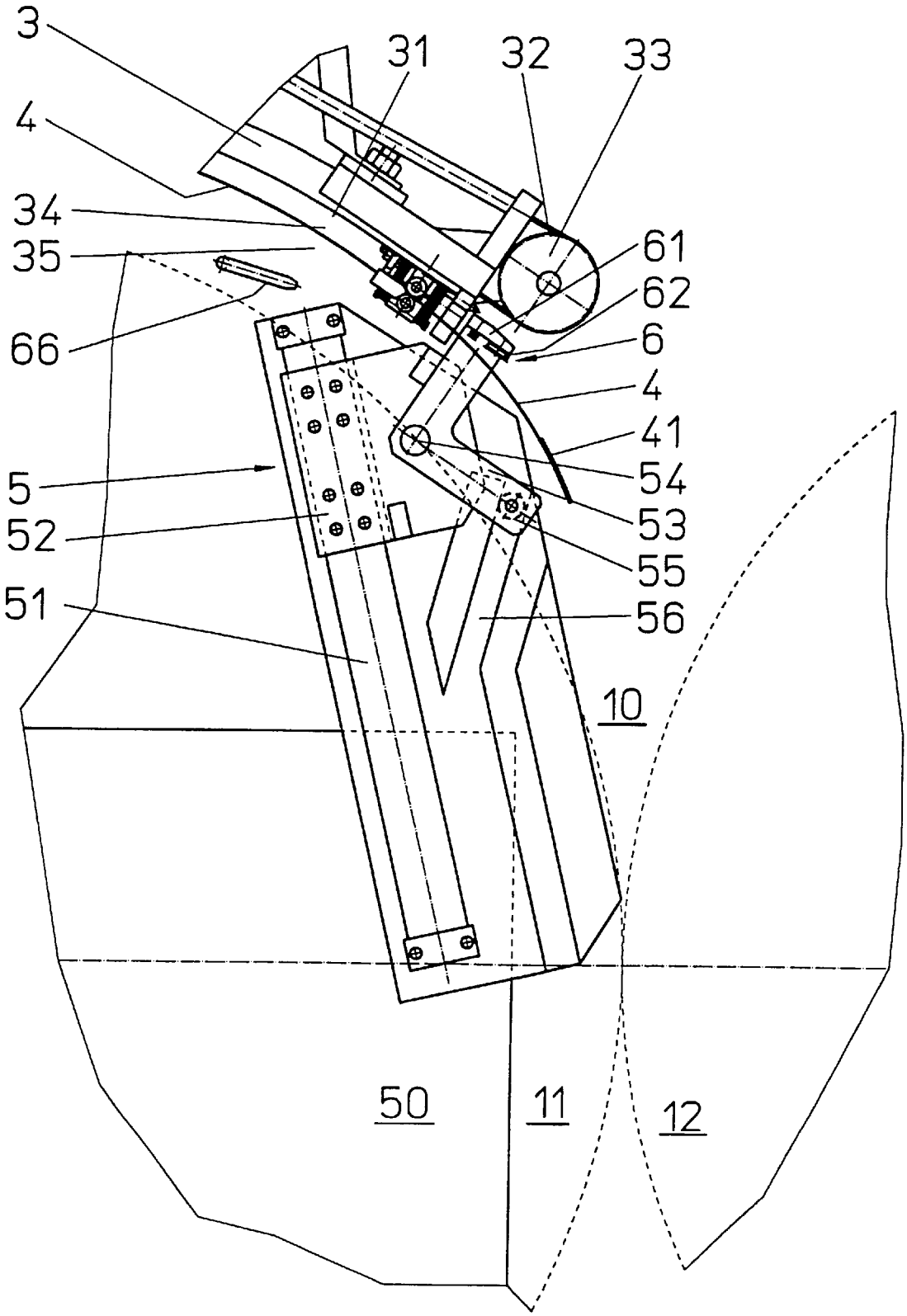

That stage is illustrated in FIG. 3 of the drawing.

As noted above, the tear strip 4 advantageously has a very low degree of stiffness or it is very soft and elastic. The invention therefore provides for a further device 5, which is carried by a frame 50 and by means of which the tear strip 4 is advanced in order to initiate the severing operation.

Figure 5:
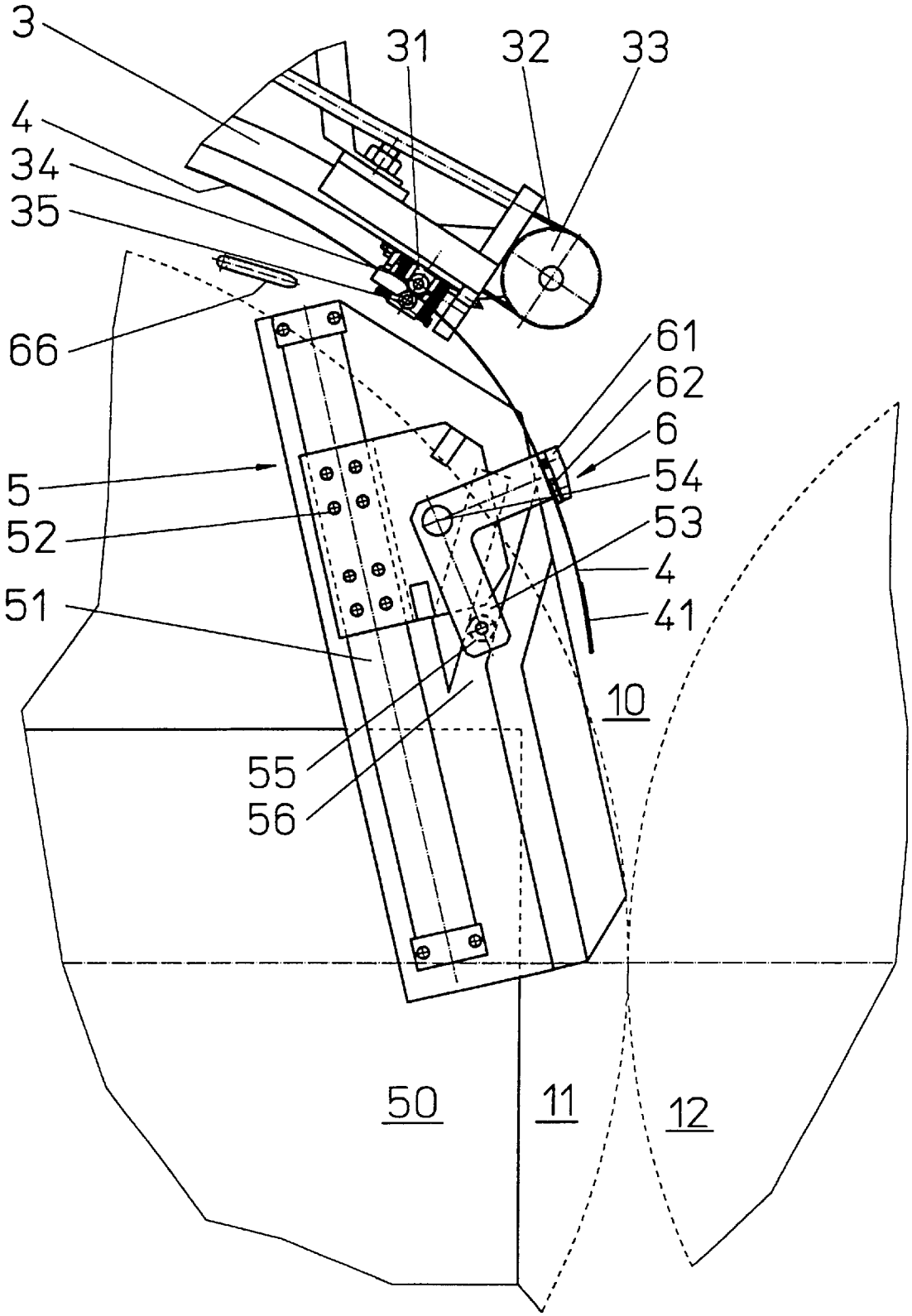
Figure 6:
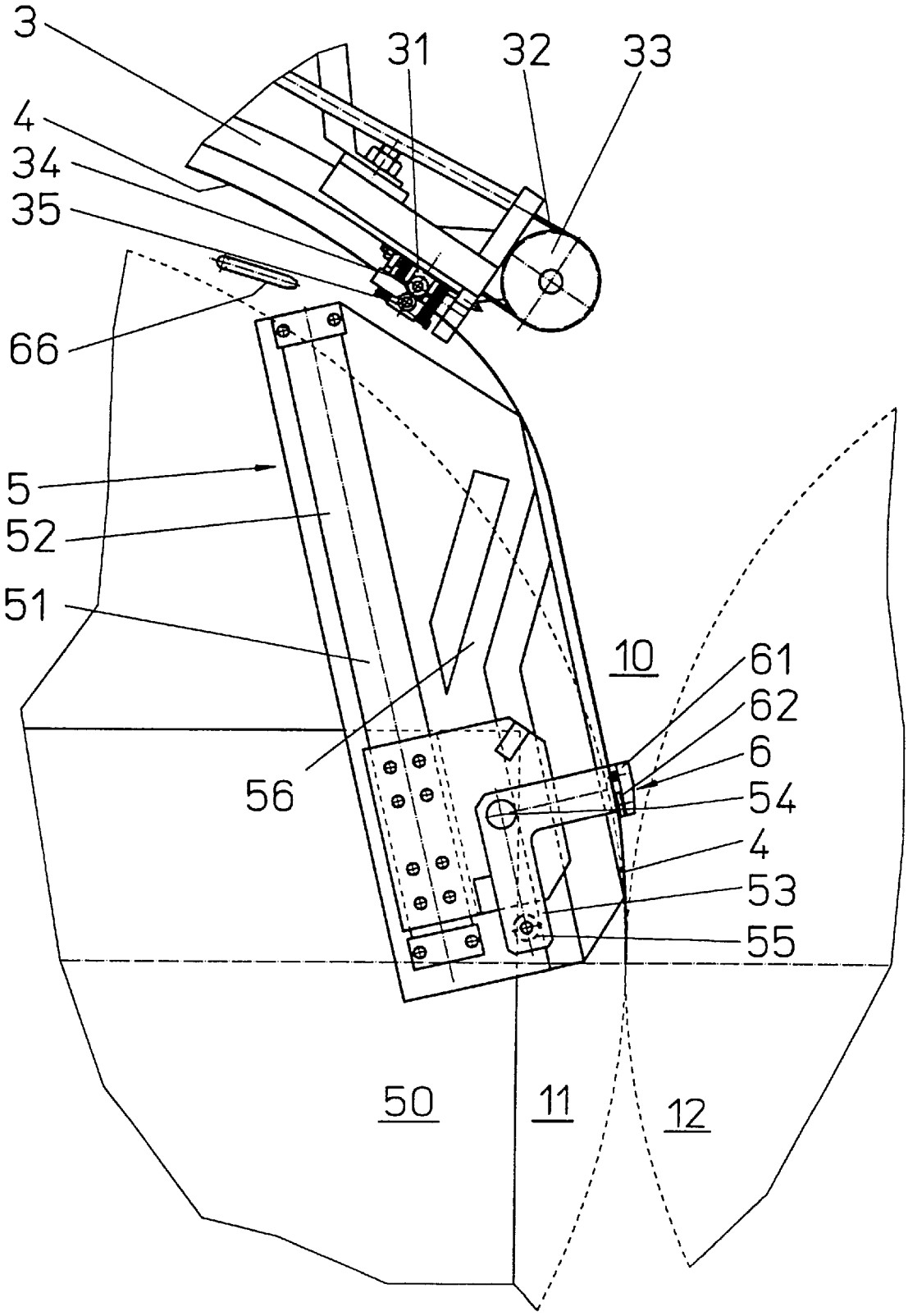
Figure 7:
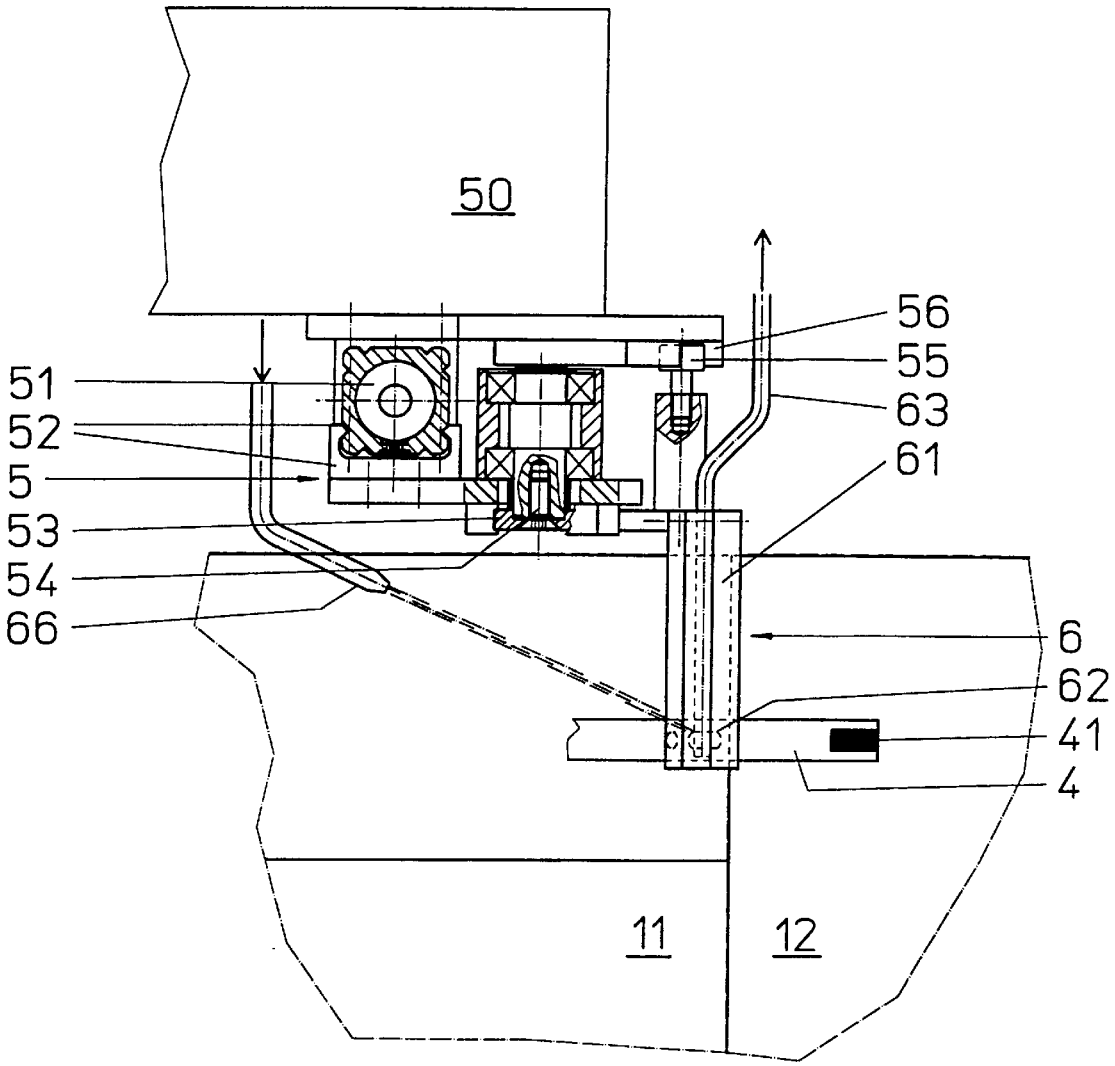
FIG. 7 is a partly horizontal sectional view and plan view of the device of FIGS. 1 to 6.

With reference to FIGS. 1–6 and to FIG. 7, the further device 5 is located laterally outside the two drums 11 and 12. This device 5 includes a carriage 52 which can be displaced along a fixed rod 51 and on which a holding device 6 for the tear strip 4 is pivotally mounted. The carriage 52 can be displaced hydraulically, pneumatically or electrically in a direction transverse to the axes of rotation of the two drums 11 and 12. Also mounted on the carriage 52 is an angle piece 53, which is rotatable about an axis 54 which is aligned parallel to the axes of rotation of the two drums 11 and 12. One of the free ends of the angle piece 53 carries a roller 55, which is guided in a slotted guide 56. From the other end of the angle piece 53 there projects, in the direction of the axes of the drums 11 and 12, a bar 61, which projects into the nip 10 formed between the two drums 11 and 12. The free end of the bar 61 is equipped with suction cups 62, to which a suction line 63 is connected.

Figure 9:
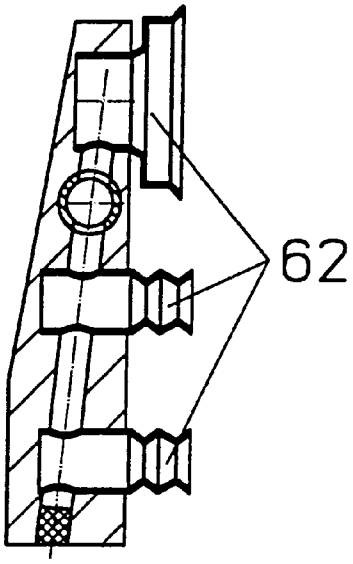
FIG. 9 is a section taken along the line IX—IX in FIG. 8 and viewed in the direction of the arrows.
Figure 8:
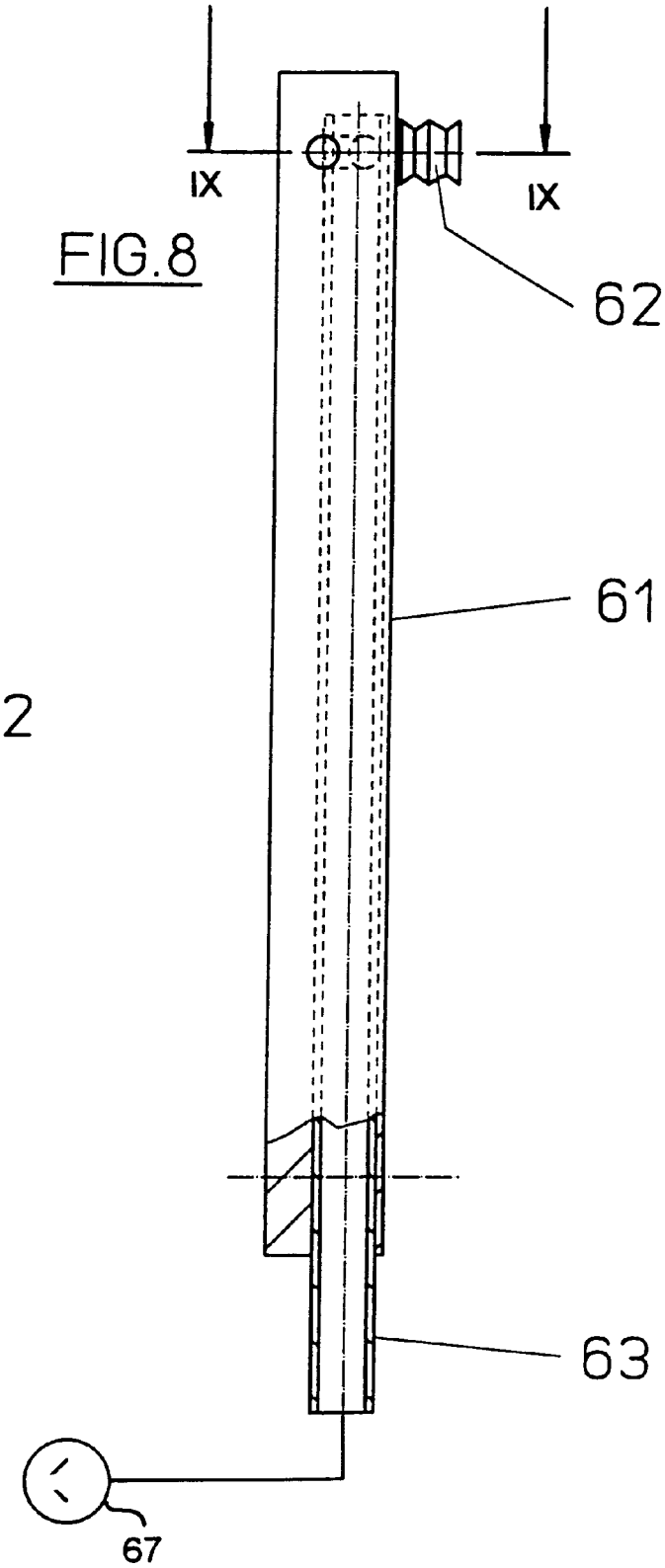
FIG. 8 is a plan view of a detail of the device.

The precise construction of the bar 61 can be seen from FIGS. 8 and 9. The bar 61 is provided at its free end with three suction cups 62, which communicate fluidically with a suction line 63. In addition, a blow nozzle 66 is provided which—as seen in particular from FIG. 7—is directed toward the tear strip 4 and toward the suction cups 62.

Figure 4:
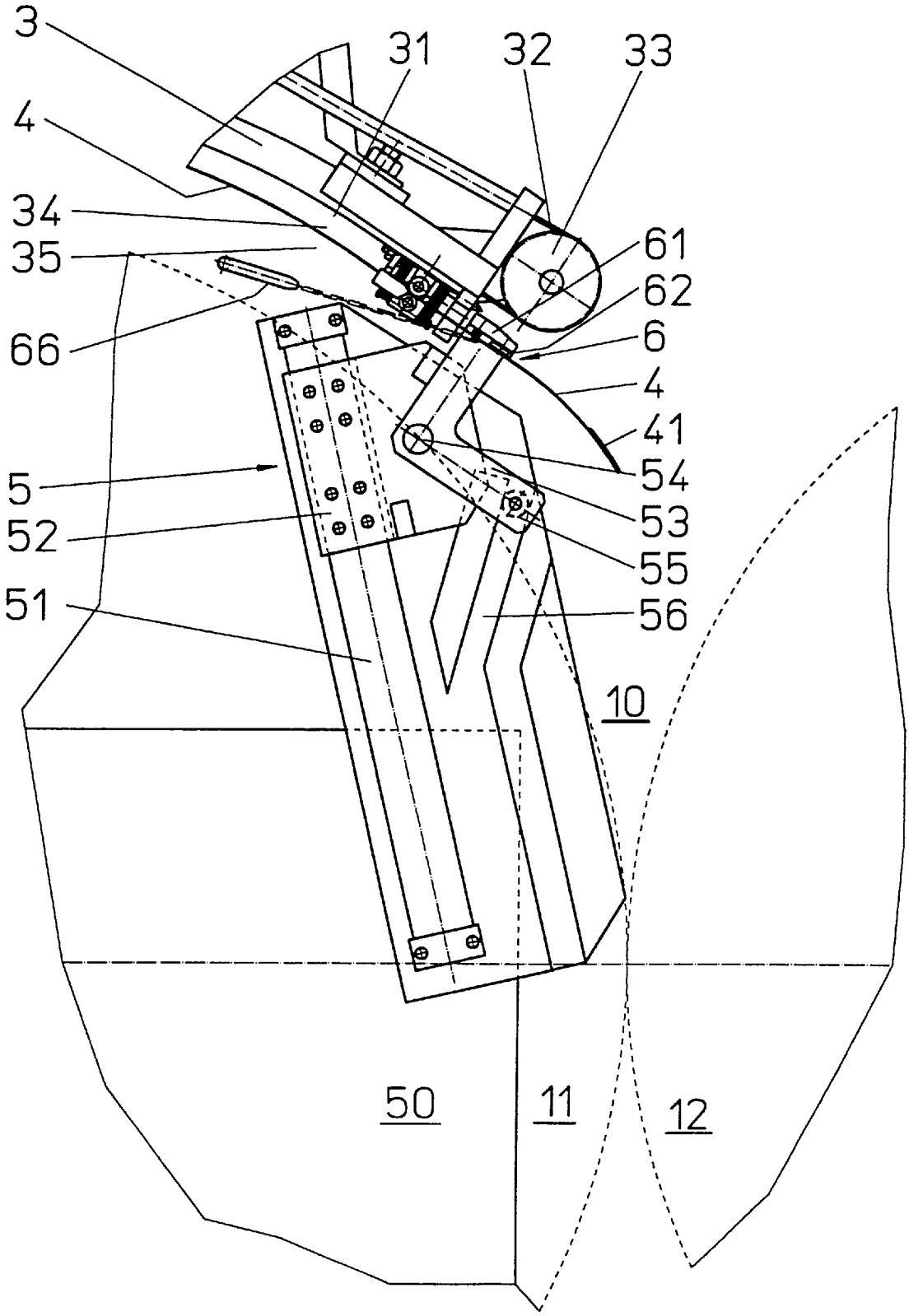

When the severing operation is to be initiated, the blow nozzle 66 is switched on, and the suction line 63 leading to the suction cups 62 is connected to a vacuum source 67. As a result, the tear strip 4 is moved towards the suction cups 62 and gripped by the latter. The tear strip 4 is then held in its position by the suction cups 62. This stage is illustrated in FIG. 4.

With reference to FIG. 5, the carriage 52 is subsequently moved along the guide rod 51 towards the two drums 11 and 12. The angle piece 53 is thereby pivoted in the clockwise direction by the roller 55, which is guided in the slotted guide 56.

With reference to FIG. 6, the free end of the tear strip 4, with its adhesive patch 41, comes to rest on the empty drum 12. There it is fastened to the drum and slaved along in its rotation. Due to the fact that the tear strip 4 is glued to the empty drum 12, which is rotating, the severing operation is initiated. The paper web is severed and is subsequently wound onto the empty drum 12.

Due to the fact that the tear strip 4 can be gripped close to its end with the novel device, the tape can be moved into the vicinity of the surface of the empty drum 12. As a result, the tear strip 4 need not be stiff at all. The disadvantages associated with stiff, thick tear strips are thus avoided.

We claim:

1. An apparatus for severing a paper web being wound onto a first rotating drum, and for initiating the winding of the paper web onto a second, empty drum, which comprises:

a tear strip extending transversely to a paper web being wound onto a first rotating drum, said tear strip having a free end to be fastened to an empty rotating drum, whereby said tear strip is helically wound onto the empty rotating drum and said tear strip severs the paper web;

a carriage disposed laterally adjacent the empty rotating drum, said carriage being displaceably mounted towards the empty drum and transversely to an axis of the empty drum; and a suction device for holding said tear strip disposed on said carriage and being movable with said carriage towards the empty drum, and a vacuum source communicating with said suction device through a suction line.

2. The apparatus according to claim 1, which further comprises a compressed-air nozzle disposed in a vicinity of said suction device for moving said tear strip towards said suction device.

3. The apparatus according to claim 1, wherein said suction device is pivotally mounted on said carriage and said suction device is pivoted relative to said carriage during a movement of said carriage.

4. The apparatus according to claim 3, which comprises an angle lever having a vertex, a first leg and a second leg, said angle lever being pivotally mounted about said vertex on said carriage, said suction device projecting transversely from said first leg of said angle lever, and a fixed slotted guide along which said second leg of said angle lever is guided during the movement of said carriage.

* * * * *